United States Patent [19]

Schuhmacher

[11] Patent Number: 4,802,611

[45] Date of Patent: Feb. 7, 1989

[54] MOVABLE REFRACTORY PLATE ASSEMBLY WITH MOVABLE REFRACTORY CONTROL MEMBER

[75] Inventor: Otto Schuhmacher, Plankstadt, Fed. Rep. of Germany

[73] Assignee: Didier-Werke AG, Wiesbaden, Fed. Rep. of Germany

[21] Appl. No.: 943,938

[22] Filed: Dec. 9, 1986

[30] Foreign Application Priority Data

Dec. 21, 1985 [DE] Fed. Rep. of Germany ..... 3545764

[51] Int. Cl.[4] ..... B22D 41/08

[52] U.S. Cl. ..... 222/600; 222/502; 266/236

[58] Field of Search ..... 222/597, 598, 600, 502, 222/503, 545, 561; 137/614.16, 614.17, 630.12; 251/326; 164/337, 437; 266/236

[56] References Cited

U.S. PATENT DOCUMENTS

| | | | |
|---|---|---|---|
| 2,575,464 | 11/1951 | Olsen | 222/600 X |
| 2,943,370 | 7/1960 | Murarsheed | 222/600 X |
| 3,436,023 | 4/1969 | Thalmann | 222/600 X |
| 3,618,925 | 11/1971 | Girolami | 222/600 X |
| 4,260,081 | 4/1981 | Detalle et al. | 222/503 |
| 4,278,190 | 7/1981 | Oory et al. | 222/561 |

FOREIGN PATENT DOCUMENTS

| | | | |
|---|---|---|---|
| 2357062 | 5/1975 | Fed. Rep. of Germany | 222/561 |
| 2737691 | 3/1979 | Fed. Rep. of Germany | 222/600 |
| 2834643 | 2/1980 | Fed. Rep. of Germany . | |
| 454089 | 2/1975 | U.S.S.R. | 222/598 |
| 1396952 | 6/1975 | United Kingdom | 222/600 |
| 2085126 | 1/1982 | United Kingdom | 222/598 |
| 2160952 | 8/1985 | United Kingdom | 222/600 |

*Primary Examiner*—Joseph J. Rolla
*Assistant Examiner*—Nils E. Pedersen
*Attorney, Agent, or Firm*—Wenderoth, Lind & Ponack

[57] ABSTRACT

A movable refractory plate assembly for use with a sliding closure unit for controlling the discharge of molten metal from a metallurgical vessel includes a movable refractory plate having therethrough a discharge opening and a movable frame for supporting the movable refractory plate in planar abutting contact with the stationary refractory plate of the sliding closure unit and movable between open and closed positions. A refractory control member is mounted for sliding movement relative to the movable refractory plate between selected positions restricting the cross section of the movable refractory plate discharge opening. An actuator slides the control member relative to the movable refractory plate between the selected positions. The control member and actuator are accessible from the exterior of the sliding closure unit. Thus, when the sliding closure unit is in the open position, only the control member need be actuated to achieve throttling of the size of the discharge opening.

32 Claims, 6 Drawing Sheets

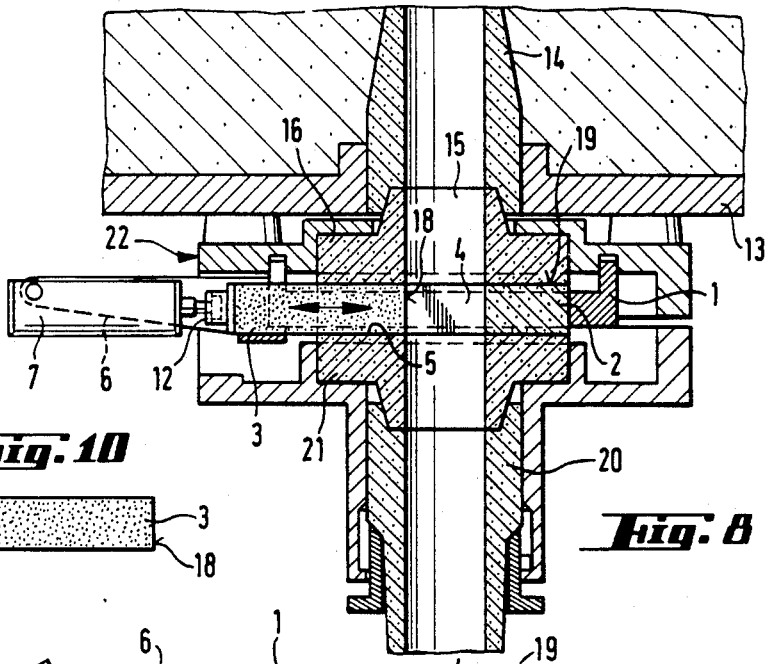
Fig. 8
Fig. 10
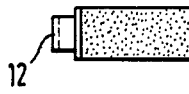
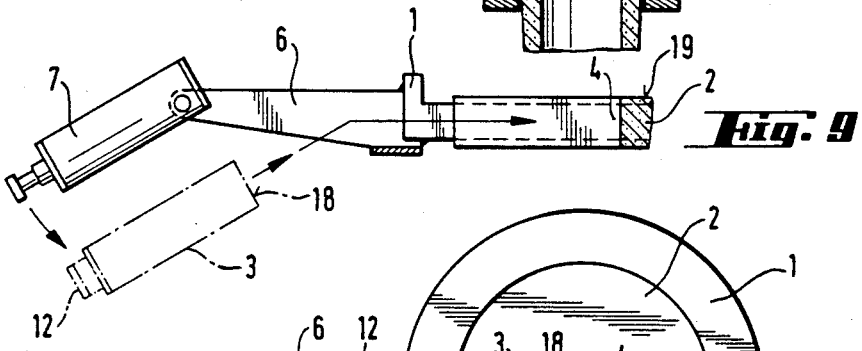
Fig. 9
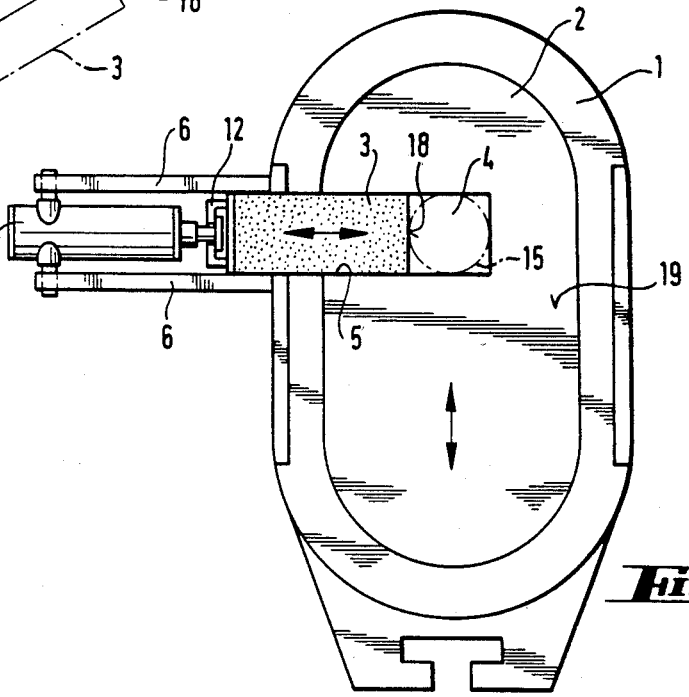
Fig. 11

MOVABLE REFRACTORY PLATE ASSEMBLY WITH MOVABLE REFRACTORY CONTROL MEMBER

BACKGROUND OF THE INVENTION

The present invention relates to a refractory plate assembly employed in a sliding closure unit for controlling the discharge of molten metal from a metallurgical vessel. More particularly, the present invention relates to such an assembly wherein the sliding closure unit is of the type including a casing to be fixed to the metallurgical vessel adjacent an outlet thereof, a stationary refractory plate mounted in the casing and having a discharge opening aligned with the vessel outlet, a movable refractory plate having therethrough a discharge opening, and a movable frame supporting the movable refractory plate in planar abutting contact with the stationary refractory plate and movable between an open position with the discharge openings of the movable and stationary refractory plates in alignment and a closed position with the discharge openings out of alignment. Further specifically, the present invention relates to such an assembly wherein the movable refractory plate is provided with a closing face and a movable plate or control member guided therein on the frame for modifying the size of the discharge opening in the movable refractory plate and thereby regulating the discharged stream of molten metal.

Such an assembly is disclosed in German DE-OS No. 28 34 643 wherein beneath the refractory bottom or stationary plate is mounted a lower plate in the form of two partial plates sliding linearly in a manner symmetrical to the teeming or discharge axis and supported in a sliding frame. Throughout the length of the range of sliding movement between the plate faces directed toward each other and controlling the pouring or discharged molten stream, the plates are flanked by lateral guides to shield the pouring stream during its discharge to the outside. Solely for sealing the plate opening, one of the partial plates has a closing face or is provided with a separate closing plate. The lateral guides may be mounted on a plate coupled with a drive mechanism, and such plate is U-shaped and receives between sides thereof the other plate. A drive connection between the two plates enable their symmetrical adjustment toward and away from each other by means of the drive mechanism acting on one plate. This known construction presents a number of problems with respect to sealing the controlling plate face area. Further, this known construction is relatively expensive, particularly because it employs two plates in symmetrical cooperation with each other by means of a connecting drive, even though the advantages of a coaxial control and slit-shaped concentration of the pouring stream are important. Another disadvantage is that it is more difficult to replace the refractory parts of the plate assembly controlling the pouring stream, compared to traditional standard movable refractory plates with at least one teeming hole and a closing surface or face. Also, this known assembly cannot be used on rotary movable or swivelly movable sliding closure units.

SUMMARY OF THE INVENTION

Accordingly, it is an object of the present invention to provide an improved such movable refractory plate assembly and sliding closure unit incorporating such assembly which overcomes the above and other prior art disadvantages.

It is a further object of the present invention to provide such an assembly and a unit employing such assembly whereby it is possible to prolong the useful life of the assembly.

It is a yet further object of the present invention to provide such an assembly and unit employing such assembly having an improved mode of operation compared with known assemblies and units.

It is an even further object of the present invention to provide such an assembly which may be employed not only in sliding closure units of the rectilinearly movable type, but also of the rotary and swivelly movable type, and whereby it is possible to produce a stabilized and flutter-free stream of discharged molten metal.

The above objects are achieved in accordance with the present invention by the provision of a refractory control member mounted for sliding movement relative to the movable refractory plate between selected positions restricting the cross section of the discharge opening through the movable refractory plate, means for sliding the control member relative to the movable refractory plate between such selected positions, with the control member and the sliding means being accessible and dismountable and replaceable from the exterior of the sliding closure unit, at least when the movable refractory plate is in the closed position thereof. Particularly, the refractory control member is selectively controllable in the open position of the movable refractory plate by means of a drive mechanism which is independent from the mechanism which moves the movable refractory plate between the open and closed positions thereof. The refractory control member alone performs, in many possible ways, the function of controlling the size of the cross section of the discharged molten metal stream, and this is done without movement of the movable refractory plate itself. As a result of these features of the present invention, premature wear of the movable refractory plate, and even of the stationary refractory plate, is reduced. Rather, the element which is eroded due to restriction of the size of the discharge orifice is the refractory control member, and this is not a disadvantage in the arrangement of the present invention, since such element readily and easily may be replaced in the closed position of the sliding closure unit. Still further, replacement of the refractory control member itself can be postponed by forming such element of a particularly highly erosion-resistant material, and this is not of great additional expense since this element is of relatively small size. This advantage is of special importance for the operation of sliding closure units employed on the tundish of a continuous casting plant, because the relatively small mass of the refractory control member permits sensitive control of the size of the discharged molten metal stream with minor drive complexity. Additionally, if the shape of the end of the control member which extends into the discharge opening in the movable refractory plate is shaped to generally correspond to or match with the shape of the discharge opening, then the controlled flow cross sectional area assumes the shape of a slit which results in a smooth, solidified and stable pouring stream which will substantially avoid the entrainment of air or oxygen, contrary to the arrangement disclosed in German DE-AS No. 12 01 013.

In accordance with a more specific feature of the present invention, the movable refractory plate has formed therein a guideway which opens into the discharge opening through the movable refractory plate, and a guide base is mounted on the movable frame and is aligned with the guideway, the guide base opening exteriorly of the casing of the sliding closure unit. The control member is slidably mounted within the guideway and the guide base, such that when the movable refractory plate is in the closed position thereof the guide base readily may be dismounted and the refractory control member may be replaced. To provide for the structural arrangement of the present invention, only a few structural changes may be made to a conventional refractory plate assembly. Such conventional plate assembly is particularly well suited to bring about the advantages of the present invention, particularly the incorporation of the refractory control member which readily may be exchanged and which easily can be operated to achieve regulation of the size of the discharge stream of molten metal.

In accordance with the present invention the guideway can extend entirely through the thickness of the movable refractory plate or may extend through only a portion of the thickness thereof. Furthermore, the control member and the guideway may have complementary guide surfaces, somewhat in the form of a tongue-in-groove arrangement. The control member may have an upper or inner surface which is coplanar with the surface of the movable refractory plate that abuts the stationary refractory plate, or alternatively the upper or inner surface of the control member may be spaced from such surface.

In further accordance with the present invention, the sliding means for moving the refractory control member within the guideway and the guide base may be in the form of a piston-cylinder assembly including a drive rod operating in a direction parallel to the direction of sliding of the control member in the guideway and the guide base, and coupling means for transferring the movement of the drive rod to the control member. In one arrangement, the piston-cylinder assembly may be double-acting and may be mounted on the movable frame at a position laterally spaced from but parallel to the guide base. Alternatively, the piston-cylinder assembly may be removably mounted on the guide base at a position exterior of the movable frame and in alignment with the guide base and guideway. Further, the piston-cylinder assembly may be mounted on the casing such that it automatically connects with the coupling means upon movement of the movable refractory plate to the open position thereof and automatically disconnects from the coupling means upon movement of the movable refractory plate to the closed position thereof.

When the discharge opening in the movable refractory plate is circular, then the inner end of the control member which extends into the discharge opening is of a substantially correspondingly rounded shape. When the discharge opening in the movable refractory plate is polygonal, then the control member preferably has at least one inner end surface parallel with at least one of the sides of the polygon which forms the discharge opening. The polygon of the discharge opening may be triangular or rectangular. In any case, it is of advantage to provide a generally complementary shape between the cross section of the discharge opening and the inner end of the control member, to result in a generally slot-shaped cross section of the casting stream which is symmetrically adjustable by sliding movement of the control member. In an advantageous arrangement, particularly for use when the discharge opening is of a polygonal shape, first and second control members extend toward the discharge opening from opposite sides thereof, in respective guideways and guide bases.

BRIEF DESCRIPTION OF THE DRAWINGS

Other objects, features and advantages of the present invention will be apparent from the following detailed description of preferred embodiments, with reference to the accompanying drawings, wherein:

FIG. 8 is a transverse sectional view of a sliding closure unit attached to a metallurgical vessel and according to a second embodiment of the present invention;

FIG. 9 is a sectional view illustrating a portion of the arrangement of FIG. 8;

FIG. 10 is an elevation view of a control member used in the embodiment of FIG. 8;

FIG. 11 is a top plan view of a movable refractory plate assembly in accordance with the embodiment of FIG. 8;

DETAILED DESCRIPTION OF THE INVENTION

Figure 1:
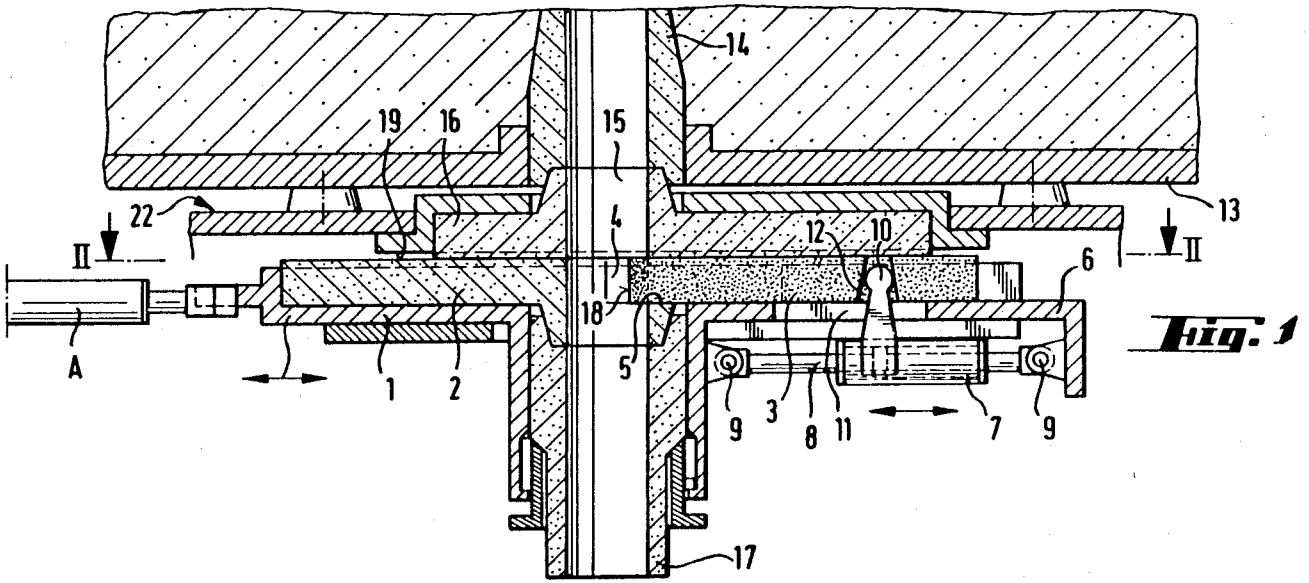
FIG. 1 is a longitudinal sectional view through a rectilinearly movable sliding closure unit mounted on the bottom of a metallurgical vessel and illustrating a first embodiment of the present invention.

In the embodiments shown in FIGS. 1–7, a metallurgical vessel 13 has therethrough an outlet nozzle 14. Fixed to the exterior of the metallurgical vessel is a sliding closure unit including a casing 22 fixed to the vessel 13 adjacent the outlet 14. A stationary refractory plate 16 is mounted in casing 22 and has a discharge opening 15 aligned with the vessel outlet. A movable refractory plate 2 has therethrough a discharge opening 4, and a movable frame 1 supports movable refractory plate 2 in planar abutting contact with stationary refractory plate 16. Movable frame 1 and movable refractory plate 2 are movable rectilinearly in opposite directions, for example by control device A, between an open position, shown in FIG. 1, with the discharge openings 4, 15 in alignment, and a closed position, shown in FIG. 4, with discharge openings 4, 15 out of alignment.

The above structure is generally conventional, and device A has been employed to both move the movable refractory plate between the open and closed positions thereof and also to throttle the discharge flow of molten metal through outlet 14 and discharge openings 15, 4, as well as through outlet sleeve 17. During such use, the molten metal severely erodes the stationary and movable refractory plates adjacent the discharge openings thereof.

In accordance with the present invention, there is provided an arrangement whereby the throttling of the discharge opening is achieved, not by device A, but by another arrangement when the movable refractory plate is in the open position thereof shown in FIG. 1. Thus, movable refractory plate 2 has formed therein a guideway 5 which opens into discharge opening 4. A guide base 6 is mounted on movable frame 1 and is aligned with guideway 5. A refractory control member 3 is mounted for sliding movement relative to movable refractory plate 2 within guideway 5 and guide base 6 in opposite directions to thereby increase or decrease in a selected manner the size of the cross section of discharge opening 4, thereby achieving throttling of the molten metal discharge.

Figures 4, 5, 6, 7:
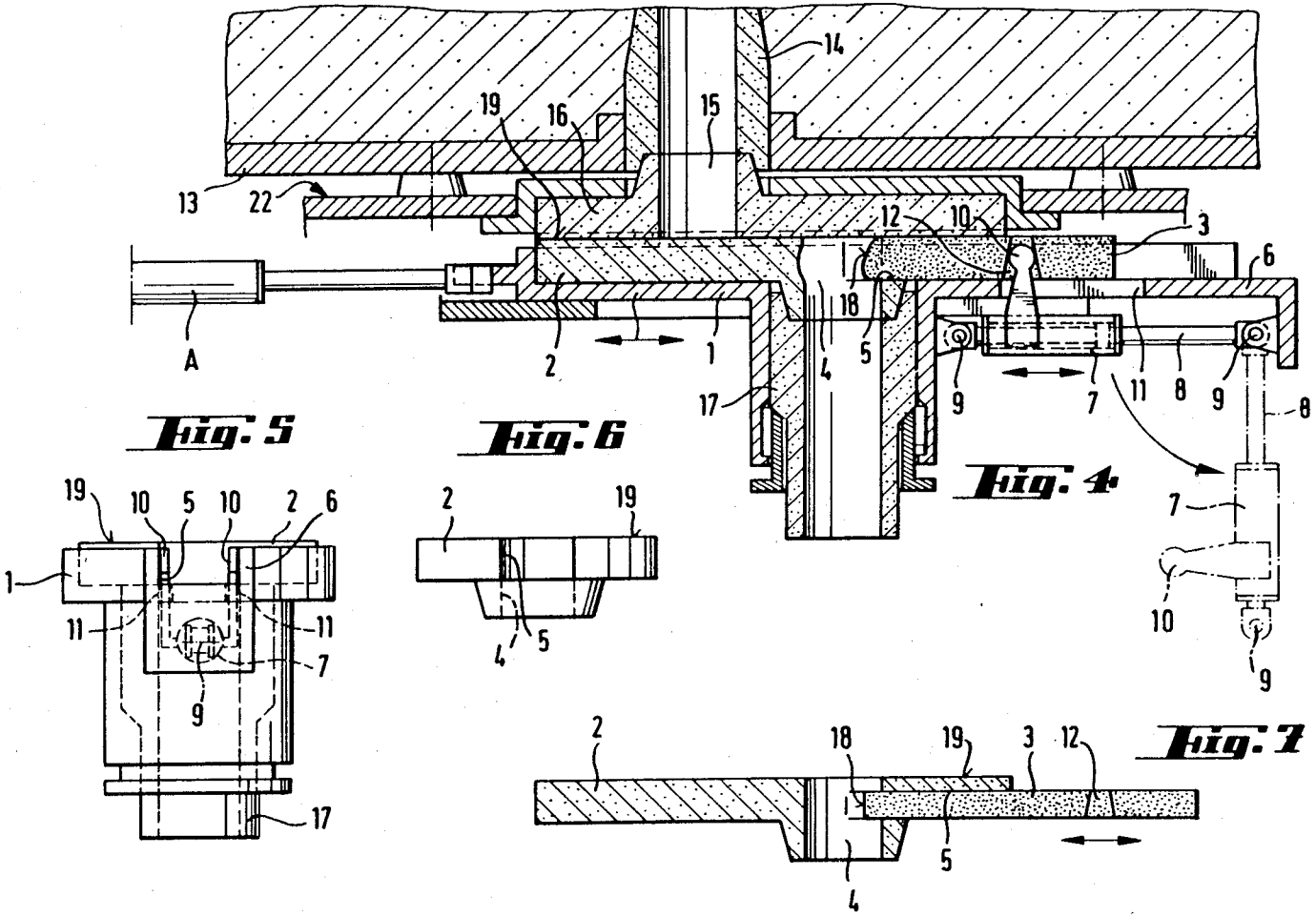
FIG. 4 is a view similar to FIG. 1 but illustrating the sliding closure unit in the closed position thereof.
FIG. 5 is a side view taken in the direction of arrows V—V of FIG. 2.
FIG. 6 is a view similar to FIG. 5 but of the movable refractory plate modified according to the present invention.
FIG. 7 is a longitudinal sectional view through a movable refractory plate incorporating the control member of the present invention according to a modification of the first embodiment.

Specifically, mounted between movable frame 1 and guide base 6 is a double-acting piston-cylinder assembly 7 having a double piston rod 8 pivotally mounted at 9. The piston of assembly 7 moves coupling members 10 which extend through slots 11 in guide base 6 into recesses 12 formed in opposite lateral sides of control member 3. It will be apparent therefore that operation of assembly 7 causes movement of coupling elements 10 in opposite directions toward and away from discharge opening 4. This results in sliding movement of control member 3 to thus selectively increase or decrease the size of the discharge stream of molten metal. The control member 3 and the assembly 7 easily are accessible from the exterior of casing 22. Particularly, as shown in dashed lines in FIG. 4, the assembly 7 readily may be uncoupled from one pivot 9 and moved to a position enabling easy removal and replacement of control member 3. This is achieved when the movable refractory plate is in the closed position thereof, upon operation of device A, as shown in FIG. 4.

As particularly will be apparent from FIG. 1, control member 3 can be moved into and out of the discharge opening 4 to vary the cross section thereof by operation of assembly 7 totally independently of the operation of actuator or device A. Consequently, the discharge of the molten metal from the vessel 13 and outlet sleeve 14 is accurately controlled by member 3, totally independently of the operation of actuator A. Of course, relative motions of movable refractory plate 2 and control member 3 are possible by actuator A and assembly 7. However, it is contemplated according to the present invention that actuator A serves solely for the purpose of moving the movable refractory plate 2 between the open position shown in FIG. 1 and the closed position shown in FIG. 4. On the other hand, it is contemplated that assembly 7 will perform exclusively the adjustment and throttling of the cross section of the discharge opening 4 when the plate 2 is in the open position thereof. As a result, erosion of stationary plate 16 substantially is avoided, and erosion of movable plate 2 is substantially reduced. Erosion occurs primarily on the inner end 18 of control member 3, and little erosion occurs on the surfaces of plate 2 defining the remainder of discharge opening 4. When the end 18 of control member 3 is eroded to an extent such that the desired degree of adjustment no longer can be achieved, then control member 3 readily can be replaced from outside of the casing 22 when actuator A moves plate 2 to the closed position of FIG. 4.

Figure 2:
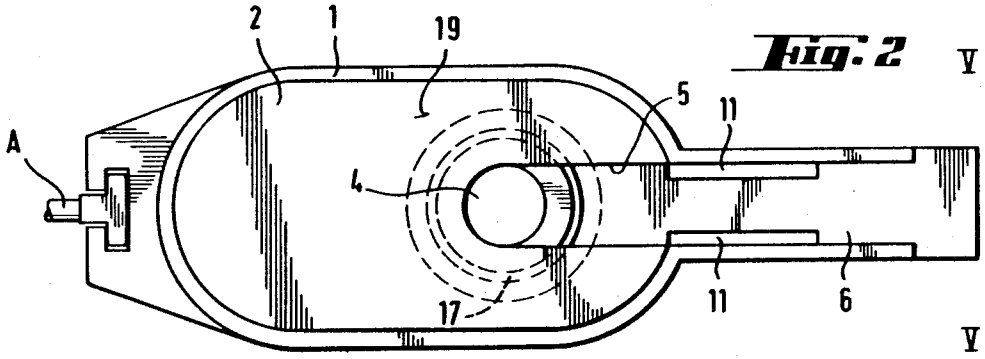
FIG. 2 is a top plan view of the movable refractory plate assembly thereof, with a control member according to the present invention removed therefrom.
Figure 3:
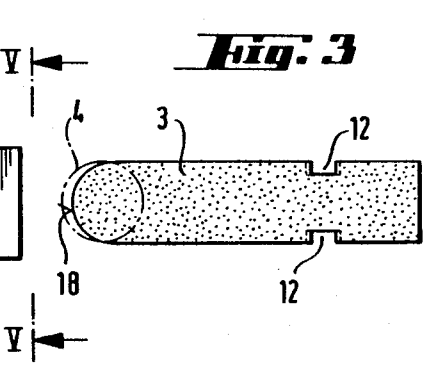
FIG. 3 is a top plan view of a control member employed in the embodiment of FIGS. 1 and 2.

It is contemplated that in the innermost position of control member 3, there will be in existence a minimal open cross section of discharge opening 4, such that discharge opening 4 is never completely closed by control member 3. That is, there always will be maintained some clearance between end 18 of control member 3 and the opposite wall of discharge opening 4. As a result, erosion that occurs will not influence normal operation which does not require a complete closure by control member 3. Furthermore, the configurations of discharge opening 4 and end surface 18 of control member 3 are, as shown in FIGS. 2 and 3, generally complementary, to result in the formation of a slot-like cross section of the discharge area. This advantageously compacts and solidifies the discharge stream of molten metal.

The movable refractory plate 2 and control member 3 readily can be manufactured without special cutting or machining operations, and specifically easily may be molded. The same is true for the modified arrangement of FIG. 7 wherein the control member 3 is spaced from abutting planar surface 19 of the movable plate 2. The guideway 5 in this arrangement may be formed simply by the use of a mold including a removable core.

The relative arrangements of frame 1, movable refractory plate 2, control member 3, guideway 5 and guide base 6, as well as the arrangement of the piston-cylinder assembly 7, can be achieved in a number of ways other than illustrated in the embodiment of FIGS. 1–7.

Attention particularly is directed to FIGS. 8–11 which illustrate a further embodiment of the present invention, specifically adapted for use in a three-plate sliding closure unit including the upper stationary plate 16, the movable plate 2, and a lower stationary plate 21. This embodiment differs from the previous embodiment in that the discharge opening 4 has a square shape the sides of which are tangent to the circular discharge opening 15 of upper stationary plate 16. Furthermore, the control member 3 is movable in a direction transverse to the direction of movement of plate 2 by means of actuator A (not shown in this embodiment). Further, the guide base 6 is fixed to the exterior of frame 1 and pivotally supports assembly 7 for movement between the operative position shown in FIG. 8 with the piston rod of assembly 7 coupled to coupling brackets 12, and a replacement position shown schematically in FIG. 9 whereat the coupling brackets 12 and control member 3 may be removed. In this arrangement, end 18 of control member 3 is planar such that movement of control member 3 into and out of guideway 5 results in discharge opening 4 being of varying rectangular size, and at the smallest is slot-like. Lower stationary plate 21 supports outlet nozzle 20.

Figure 12:
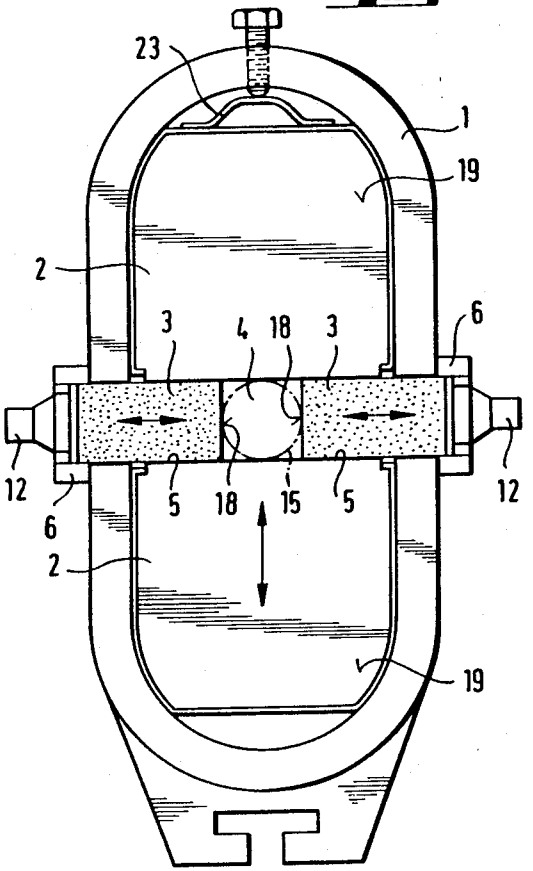

FIG. 12 illustrates a variation of the embodiment of FIG. 11 wherein there are provided two control members 3 movable into and out of discharge opening 4 from opposite long sides of rectilinearly movable refractory plate 2. Each control member 3 is provided with a respective guideway 5 and guide base 6, as well as coupling brackets 12. Coupling brackets 12 are intended to be, in the open position of plate 2, automatically coupled with fixed actuators, such as assembly 7 (not shown in FIG. 12 but similar to that shown in FIG. 8) which may be mounted, for example, on casing 22, and which may be automatically uncoupled therefrom when plate 2 moves to the closed position. By the arrangement of FIG. 12 with two control members 2, the extent of movement of each control member is reduced by half. Further, the embodiment of FIG. 12 contemplates two opposite closed positions of plate 2, from either of which the control members 3 may be replaced. Yet further, FIG. 12 shows a feature which may be incorporated into the other embodiments of the present invention, whereby the plate 2 has a metal sheath.

Figure 13:
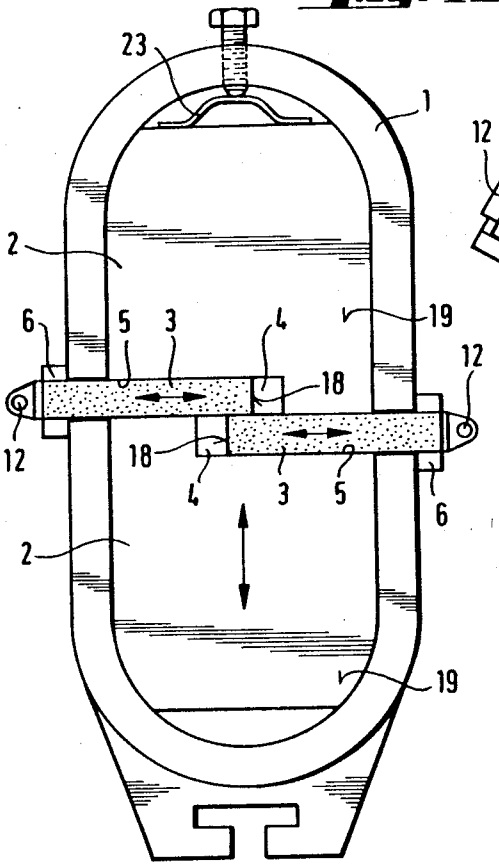

FIG. 13 illustrates a modification of the arrangement of FIG. 12 wherein the two control members 3 are not coaxial, but rather are aligned on parallel, offset axes such that they slide past each other into discharge opening 4, whereby ends 18 divide the casting stream into two streams. In both of the arrangements of FIGS. 12 and 13 it is possible to form the movable refractory plate 2 in two sections and to urge such two sections against the control members 3, for example by means of springs 23.

Figure 14:
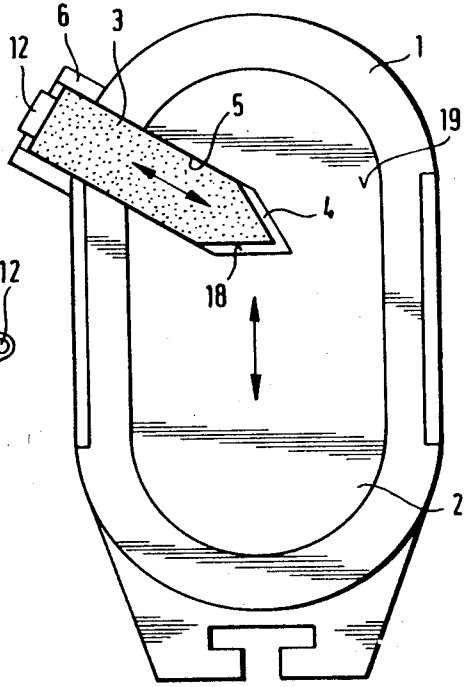
FIGS. 12 through 14 are views similar to FIG. 11 but of modifications according to the present invention.

In addition to the circular and polygonal shapes of discharge opening 4 discussed above, other shapes, such as oval, can be employed. Further, as shown in FIG. 14, a generally triangular or arrow-shaped discharge opening 4 may be provided, with one of the sides of the triangle being a side into which extends the control member 3. In this case the end 18 of control member 3 is formed by two sides which are parallel to the other two sides of the triangle. As a rule, the cross sections of outlet 14 and discharge opening 15 may be round, and the sides of a polygonal discharge opening 4 will be tangential thereto. Nevertheless, the cross sections of outlet 14 and discharge opening 15 may be identical to the polygonal shape of discharge opening 4.

Figure 16:
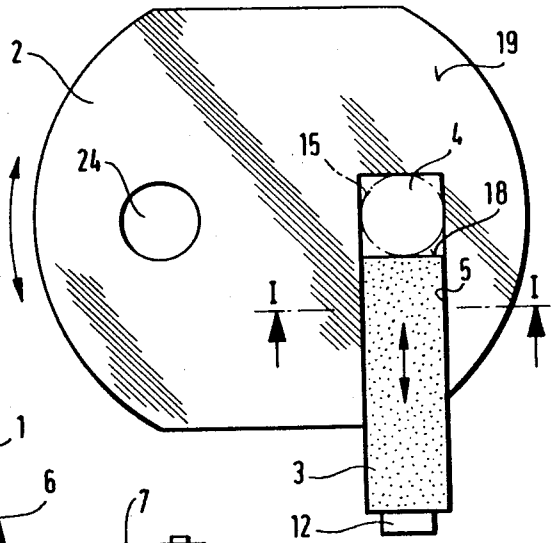
FIGS. 15 and 16 are top plan views of movable refractory plates for use in a rotary movable sliding closure unit and illustrating further embodiments of the present invention.
Figure 15:
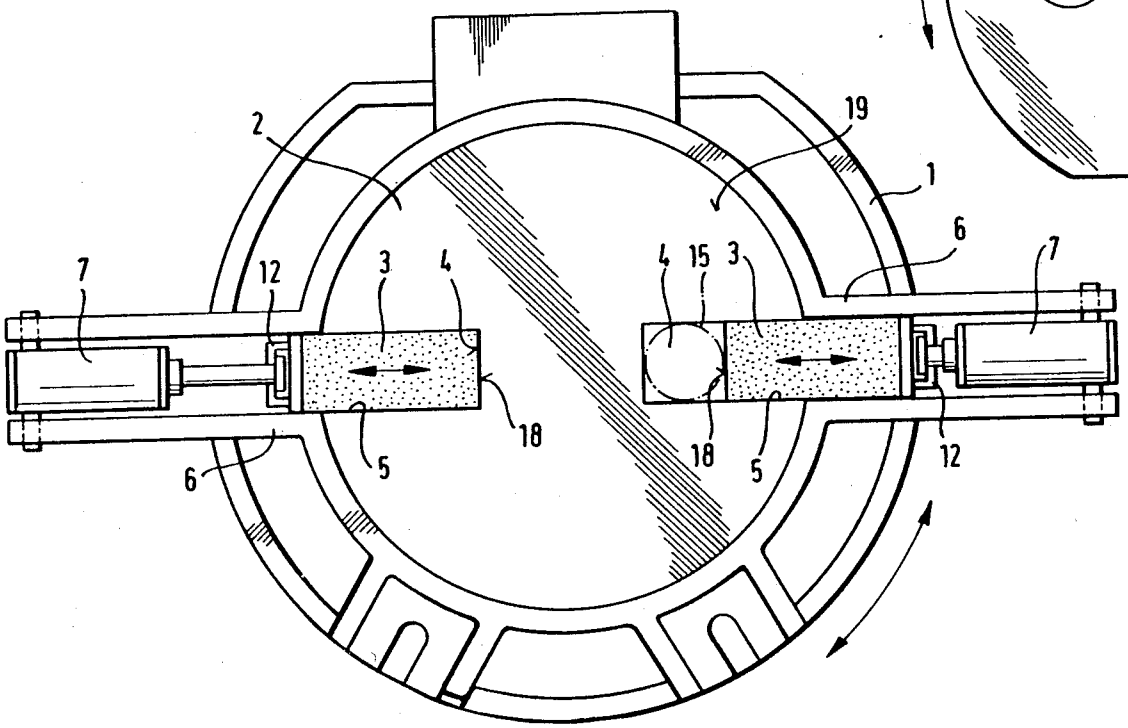

The above embodiments relate to rectilinearly movable refractory plate assemblies. The present invention however equally applies to rotary movable refractory plate assemblies. For example, FIG. 15 illustrates such an assembly including a rotary movable frame 1 and refractory plate 2. Plate 2 has therethrough two rectangular, for example square, discharge openings 4 into which extend respective control members 3 which are movable radially and colinearly. One discharge opening 4 may be employed in the open position of plate 2 to align with discharge opening 15 of stationary plate 16, and the other discharge opening 4 simply may be a spare. However, the radial arrangement of control members 3 is not absolutely necessary. FIG. 16 illustrates an arrangement wherein the control member 3 moves in a direction transverse to the radial directions, i.e. transverse to the direction in the embodiment of FIG. 15. FIG. 16 illustrates a further modification wherein there may be provided only a single rectangular discharge opening 4 and a single control member 3. Plate 2 may however be provided with a round hole 24 employed, for example, for completely opening the sliding closure unit or for feeding materials and/or gases for the metallurgical treatment of the molten metal in the vessel, or to prevent freezing of such metal in outlet nozzle 14.

Figure 17:
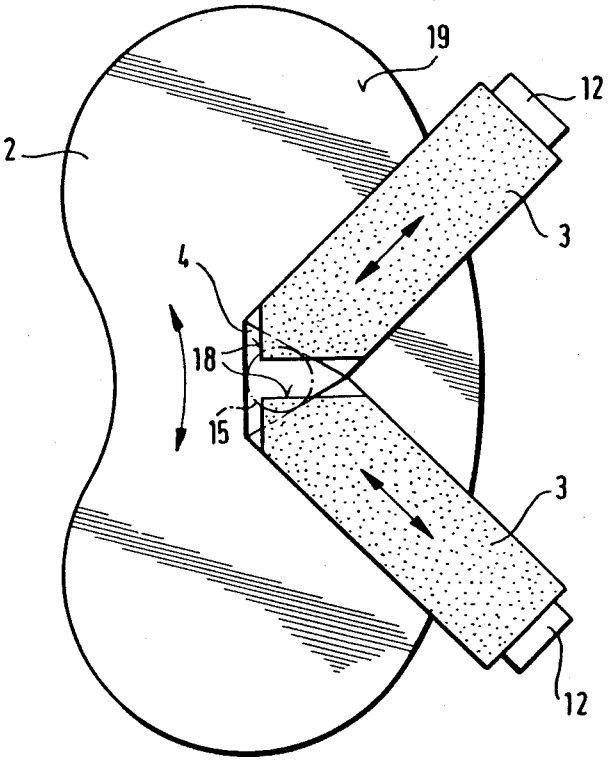
FIG. 17 is a view similar to FIG. 16, but illustrating a further embodiment of the present invention particularly employable in a sliding closure unit of the swivelly movable type.

Even further, as shown in FIG. 17, it is contemplated that the present invention be employable in movable refractory plate assemblies of the swivelly movable type. FIG. 17 even further illustrates an arrangement whereby a single discharge opening 4 has associated therewith two control members 3 positioned at an angle with respect to each other. Thus, discharge opening 4 is of triangular shape, and the ends 18 of control members 3 form a substantially T-shaped casting stream.

Figure 18:
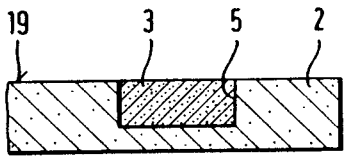
FIGS. 18–20 are cross sectional views taken along line I—I of FIG. 16 and illustrating different configurations of mating surfaces of control members and guideways according to the present invention.
Figure 19:
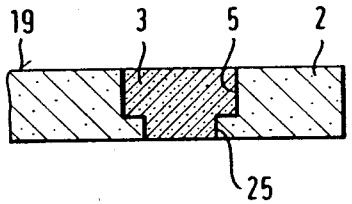
Figure 20:
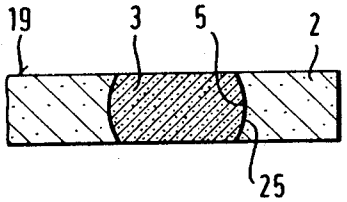

FIGS. 18 through 20 illustrate various additional possible transverse cross sectional shapes of control members 3 and guideways 5. Thus, control member 3 does not have to extend entirely through the thickness of the plate 2, as in the embodiment of FIG. 1, but rather can extend through only a portion of the thickness of plate 2, as shown in FIG. 18. On the other hand, FIGS. 19 and 20 illustrate various possible contours 25 of abutting flank surfaces of control members 3 and respective guideways 5.

It is intended to be within the scope of the present invention to combine movement of actuators A and 7, for instance to correct the position of movable refractory plate assembly 1, 2 in the open position thereof, or to define certain cross sections of the casting stream. One skilled in the art readily would understand how the motions of actuators A and 7 could be so combined as necessary or desired.

Although the present invention has been described and illustrated with respect to preferred features thereof, it is to be understood that various modifications and changes may be made to the specifically described and illustrated features without departing from the scope of the present invention.

I claim:

1. In a sliding closure unit for controlling the discharge of molten metal from a metallurgical vessel, said unit including a casing to be fixed to the metallurgical vessel adjacent an outlet thereof, a stationary refractory plate mounted in said casing and having a discharge opening aligned with the vessel outlet, a movable refractory plate having therethrough a discharge opening, a movable frame supporting said movable refractory plate in planar abutting contact with said stationary refractory plate, and means for moving said movable frame and said movable refractory plate between an open position with said discharge openings of said movable and stationary refractory plates in alignment and a closed position with said discharge openings out of alignment, the improvement comprising means for, when said movable frame and said movable refractory plate are stationary and in said open position, selectively adjusting the size of said discharge opening in said movable refractory plate and thereby regulating the amount of molten metal discharged therethrough, said adjusting means comprising:

a refractory control member mounted for sliding movement relative to said movable refractory plate between selected positions restricting the cross section of said movable refractory plate discharge opening;

means, operable independently of the operation of said moving means, for sliding said control member relative to said movable refractory plate between said selected positions; and said control member and said sliding means being accessible from the exterior of said casing, at least when said movable refractory plate is in said closed position.

2. The improvement claimed in claim 1, wherein said movable refractory plate has formed therein a guideway opening into said movable refractory plate discharge opening, further comprising a guide base mounted on said movable frame and aligned with said guideway, said guide base opening exteriorly of said casing, and said control member is slidably mounted within said guideway and said guide base.

3. The improvement claimed in claim 2, wherein said guideway extends entirely through the thickness of said movable refractory plate.

4. The improvement claimed in claim 3, wherein said control member has a surface coplanar with a surface of said movable refractory plate that abuts said stationary refractory plate.

5. The improvement claimed in claim 2, wherein said control member and said guideway have complementary guide surfaces.

6. The improvement claimed in claim 2, wherein said guideway extends through only a portion of the thickness of said movable refractory plate.

7. The improvement claimed in claim 6, wherein said control member has a surface coplanar with a surface of said movable refractory plate that abuts said stationary refractory plate.

8. The improvement claimed in claim 6, wherein said control member is spaced from a surface of said movable refractory plate that abuts said stationary refractory plate.

9. The improvement claimed in claim 2, wherein said sliding means comprises a piston-cylinder assembly including a drive rod operating in a direction parallel to the direction of sliding of said control member in said guideway and said guide base, and coupling means for transducing movement of said drive rod to said control member.

10. The improvement claimed in claim 9, wherein said piston-cylinder assembly is double-acting and is mounted on said movable frame at a position laterally spaced from and parallel to said guide base.

11. The improvement claimed in claim 9, wherein said piston-cylinder assembly is removably mounted on said guide base at a position exterior of said movable frame.

12. The improvement claimed in claim 1, wherein said discharge opening in said movable refractory plate is circular, and said control member has a substantially correspondingly rounded inner end.

13. The improvement claimed in claim 1, wherein said discharge opening in said movable refractory plate is polygonal, and said control member has at least one inner end surface parallel with at least one of the sides of the polygon forming said discharge opening.

14. The improvement claimed in claim 13, wherein said movable refractory plate discharge opening is triangular.

15. The improvement claimed in claim 13, wherein said movable refractory plate discharge opening is rectangular.

16. The improvement claimed in claim 15, comprising first and second said control members extending toward said movable refractory plate discharge opening from opposite sides thereof.

17. In a movable refractory plate assembly for use with a sliding closure unit for controlling the discharge of molten metal from a metallurgical vessel, said assembly including a movable refractory plate having therethrough a discharge opening, and a movable frame for supporting said movable refractory plate in planar abutting contact with a stationary refractory plate of a sliding closure unit and movable by moving means between an open position with said discharge opening of said movable refractory plate aligned with the discharge opening in the stationary refractory plate and a closed position with said discharge opening out of such alignment, the improvement comprising means for, when said movable frame and said movable refractory plate are stationary and in said open position, selectively adjusting the size of said discharge opening in said movable refractory plate and thereby regulating the amount of molten metal discharged therethrough, said adjusting means comprising:

a refractory control member mounted for sliding movement relative to said movable refractory plate between selected positions restricting the cross section of said movable refractory plate discharge opening;

means, operable independently of the operation of the moving means, for sliding said control member relative to said movable refractory plate between said selected positions; and said control member and said sliding means being accessible from the exterior of the sliding closure unit, at least when said movable refractory plate is in said closed position.

18. The improvement claimed in claim 17, wherein said movable refractory plate has formed therein a guideway opening into said movable refractory plate discharge opening, further comprising a guide base mounted on said movable frame and aligned with said guideway, said guide base opening exteriorly of the sliding closure unit, and said control member is slidably mounted within said guideway and said guide base.

19. The improvement claimed in claim 18, wherein said guideway extends entirely through the thickness of said movable refractory plate.

20. The improvement claimed in claim 19, wherein said control member has a surface coplanar with a surface of said movable refractory plate that is to abut the stationary refractory plate.

21. The improvement claimed in claim 18, wherein said control member and said guideway have complementary guide surfaces.

22. The improvement claimed in claim 18, wherein said guideway extends through only a portion of the thickness of said movable refractory plate.

23. The improvement claimed in claim 22, wherein said control member has a surface coplanar with a surface of said movable refractory plate that is to abut the stationary refractory plate.

24. The improvement claimed in claim 22, wherein said control member is spaced from a surface of said movable refractory plate that is to abut the stationary refractory plate.

25. The improvement claimed in claim 18, wherein said sliding means comprises a piston-cylinder assembly including a drive rod operating in a direction parallel to the direction of sliding of said control member in said guideway and said guide base, and coupling means for transducing movement of said drive rod to said control member.

26. The improvement claimed in claim 25, wherein said piston-cylinder assembly is double-acting and is mounted on said movable frame at a position laterally spaced from and parallel to said guide base.

27. The improvement claimed in claim 25, wherein said piston-cylinder assembly is removably mounted on said guide base at a position exterior of said movable frame.

28. The improvement claimed in claim 17, wherein said discharge opening in said movable refractory plate is circular, and said control member has a substantially correspondingly rounded inner end.

29. The improvement claimed in claim 17, wherein said discharge opening in said movable refractory plate is polygonal, and said control member has at least one inner end surface parallel with at least one of the sides of the polygon forming said discharge opening.

30. The improvement claimed in claim 29, wherein said movable refractory plate discharge opening is triangular.

31. The improvement claimed in claim 29, wherein said movable refractory plate discharge opening is rectangular.

32. The improvement claimed in claim 31, comprising first and second said control members extending toward said movable refractory plate discharge opening from opposite sides thereof.

* * * * *